US006239686B1

(12) United States Patent
Eder et al.

(10) Patent No.: US 6,239,686 B1
(45) Date of Patent: May 29, 2001

(54) TEMPERATURE RESPONSIVE SWITCH WITH SHAPE MEMORY ACTUATOR

(75) Inventors: Philip B. Eder, Mansfield; William F. Quinn, Greenwich; Mark A. Roberts, Mansfield; Richard E. Welch, Lexington, all of OH (US); David W. Clow, Spring Lake, MI (US)

(73) Assignee: Therm-O-Disc, Incorporated, Mansfield, OH (US)

( * ) Notice: Subject to any disclaimer, the term of this patent is extended or adjusted under 35 U.S.C. 154(b) by 0 days.

(21) Appl. No.: 09/369,729

(22) Filed: Aug. 6, 1999

(51) Int. Cl.[7] ..... H01H 37/46; H01H 37/72

(52) U.S. Cl. ..... 337/382; 337/123; 337/298; 337/383; 337/398; 337/139; 337/140; 60/528

(58) Field of Search ..... 337/382, 298, 337/12, 140, 139, 339, 141, 343, 123, 393, 398, 14, 383; 60/527, 528; 251/129.02; 148/402, 563; 439/261, 267, 325, 630, 932; 429/61, 62, 57, 66, 58, 54, 7, 122, 174

(56) References Cited

U.S. PATENT DOCUMENTS

| | | | | |
|---|---|---|---|---|
| 2,497,397 | | 2/1950 | Dales . | |
| 2,743,335 | | 4/1956 | Moyer . | |
| 3,213,250 | | 10/1965 | Marcoux . | |
| 3,474,372 | | 10/1969 | Davenport et al. . | |
| 3,707,694 | | 12/1972 | DuRocher . | |
| 3,725,835 | * | 4/1973 | Hopkins et al. | 337/140 |
| 3,748,197 | * | 7/1973 | Willson et al. | 148/131 |
| 3,801,944 | | 4/1974 | Brown . | |
| 3,869,690 | * | 3/1975 | Hickling | 337/390 |
| 3,893,055 | * | 7/1975 | Jost et al. | 337/140 |
| 4,035,552 | | 7/1977 | Epstein . | |
| 4,188,460 | | 2/1980 | Kang et al. . | |
| 4,205,293 | * | 5/1980 | Melton et al. | 337/140 |
| 4,356,478 | | 10/1982 | Muggli et al. . | |
| 4,374,311 | | 2/1983 | Okahashi et al. . | |
| 4,395,694 | | 7/1983 | Wehl . | |
| 4,503,131 | | 3/1985 | Baudrand . | |
| 4,517,543 | * | 5/1985 | Brubaker | 337/140 |
| 4,520,336 | * | 5/1985 | Hastings et al. | 337/140 |
| 4,524,343 | * | 6/1985 | Morgan et al. | 337/140 |
| 4,544,988 | * | 10/1985 | Hochstein | 361/211 |
| 4,736,587 | * | 4/1988 | Suzuki | 60/528 |
| 4,774,151 | | 9/1988 | Cuomo et al. . | |
| 4,782,318 | | 11/1988 | Boulanger . | |
| 4,806,815 | * | 2/1989 | Honma | 310/307 |

(List continued on next page.)

FOREIGN PATENT DOCUMENTS

| | | |
|---|---|---|
| 0 689 255 A3 | 3/1996 | (EP) . |
| 0 700 109 A1 | 3/1996 | (EP) . |
| 0 757 394 A1 | 2/1997 | (EP) . |
| 0 773 595 A1 | 5/1997 | (EP) . |
| 63 175 345 | 7/1984 | (JP) . |
| 59-191273 | 10/1984 | (JP) . |
| 59-203376 | 11/1984 | (JP) . |
| 4-345724 | 12/1992 | (JP) . |
| 0 689 255 A2 | 5/1995 | (JP) . |
| 8-185849 | 7/1996 | (JP) . |
| 8-236102 | 9/1996 | (JP) . |

*Primary Examiner*—Leo P. Picard
*Assistant Examiner*—Anatoly Vortman
(74) *Attorney, Agent, or Firm*—Harness, Dickey & Pierce

(57) ABSTRACT

A temperature actuated switch having a resilient switch blade that is movable between open and closed positions and extends perpendicular to an elongated actuator of shape memory alloy. The actuator has an elongated deformed shape at normal temperatures and a contracted recovered shape at an elevated temperature. An end portion of the actuator is attached to the switch blade to provide movement of same between open and closed positions as the actuator changes between its deformed and recovered shapes.

26 Claims, 2 Drawing Sheets

U.S. PATENT DOCUMENTS

| | | | | |
|---|---|---|---|---|
| 4,818,641 | | 4/1989 | Ledenican . | |
| 4,821,010 | | 4/1989 | Plasko . | |
| 4,855,195 | | 8/1989 | Georgopoulos et al. . | |
| 4,973,936 | | 11/1990 | Dimpault-Darcy et al. . | |
| 4,975,341 | | 12/1990 | Tucholski et al. . | |
| 4,992,339 | | 2/1991 | Georgopoulos . | |
| 5,001,446 | * | 3/1991 | Tsuji et al. | 335/43 |
| 5,026,615 | | 6/1991 | Tucholski . | |
| 5,061,914 | | 10/1991 | Busch et al. . | |
| 5,105,178 | * | 4/1992 | Krumme | 337/140 |
| 5,188,909 | | 2/1993 | Pedicini . | |
| 5,206,622 | | 4/1993 | Lattari . | |
| 5,268,664 | | 12/1993 | Givler . | |
| 5,337,036 | | 8/1994 | Kuczynski . | |
| 5,376,467 | | 12/1994 | Abe et al. . | |
| 5,420,561 | * | 5/1995 | Swensen | 337/365 |
| 5,567,539 | | 10/1996 | Takahashi et al. . | |
| 5,619,177 | | 4/1997 | Johnson et al. . | |
| 5,691,073 | | 11/1997 | Vu et al. . | |
| 5,747,187 | | 5/1998 | Byon . | |
| 5,750,277 | | 5/1998 | Vu et al. . | |
| 5,766,790 | | 6/1998 | Kameishi et al. . | |
| 5,766,793 | | 6/1998 | Kameishi et al. . | |
| 5,825,275 | | 10/1998 | Wuttig et al. . | |
| 5,844,464 | | 12/1998 | Kalapodis et al. . | |
| 5,879,832 | | 3/1999 | Vu et al. . | |
| 5,977,858 | * | 11/1999 | Morgen et al. | 337/140 |
| 6,005,469 | * | 12/1999 | Kalapodis et al. | 337/140 |
| 6,018,286 | * | 1/2000 | Quinn et al. | 337/140 |
| 6,049,267 | * | 4/2000 | Barnes et al. | 337/123 |

* cited by examiner

TEMPERATURE RESPONSIVE SWITCH WITH SHAPE MEMORY ACTUATOR

BACKGROUND OF THE INVENTION

This application relates to the art of switches and, more particularly, to temperature actuated switches that use actuators of shape memory alloy. The invention is particularly applicable to very small relays or thermostats having a resilient switch blade that extends generally perpendicular to an elongated actuator of shape memory alloy and will be described with specific reference thereto. However, it will be appreciated that the invention has broader aspects, and that it can be used in other types of temperature actuated switches that have other arrangements of the actuator and switch blade.

Extremely small relays and thermostats are very complicated due to the use of a relatively large number of parts and the difficulty of reliably producing the parts in very small sizes. The same considerations make such relays and thermostats relatively difficult to manufacture and assemble, and makes them relatively expensive. It would be desirable to have a temperature actuated switch that is capable of being manufactured in extremely small sizes with a minimum number of parts, and that can be manufactured and assembled in a relatively efficient and reliable manner.

SUMMARY OF THE INVENTION

A polymeric housing for a relay has a cavity therein receiving a resilient switch blade and an elongated actuator of shape memory alloy that provides movement of the switch blade between open and closed positions. A pair of terminal members have fixed terminal contacts positioned in the cavity and terminal leads that extend externally of the housing from the terminal contacts. The switch blade has a movable blade contact for cooperation with one of the fixed terminal contacts as the switch blade moves between its open and closed positions.

The elongated actuator of shape memory alloy has an extended deformed shape at normal temperatures and a contracted recovered shape at an elevated temperature. An end portion of the actuator is attached to the switch blade to provide movement of the switch blade between its open and closed positions with variations in the actuator length as the actuator changes between its deformed and recovered shapes.

In a preferred arrangement, the relay is normally closed with the movable contact being biased into engagement with the one terminal contact by the force of bending stress in the resilient switch blade. When the actuator changes to its recovered shape at an elevated temperature, the actuator length contracts and pulls the switch blade in a direction to move the movable contact away from the one fixed terminal contact. Upon cooling, the actuator preferably reverts to its extended deformed shape to allow the switch blade to return to its closed position with the movable contact engaging the one fixed terminal contact.

In one arrangement, the switch blade extends generally perpendicular to the elongated actuator of shape memory alloy, and the actuator is attached to the switch blade at a point intermediate its opposite ends.

In another arrangement, the actuator has the shape of a coil spring with a plurality of coil turns and the spring actuator is attached to the resilient switch blade by extending the blade between adjacent coils in an end portion of the spring actuator.

In another arrangement, an anchor projection in the housing cavity is attached to a distal end portion of the actuator remote from the switch blade. In a preferred arrangement, the anchor projection is molded integrally in one piece with the housing and extends between adjacent coils in the distal end portion of the spring actuator.

In accordance with another aspect of the application, the resilient switch blade is on a generally U-shaped switch blade member that has a pair of substantially parallel arms connected by a base portion. One of the arms is longer than the other arm and defines the resilient switch blade, and the other arm engages the other terminal contact.

The polymeric housing has opposite ends, opposite sides, and opposite front and rear surfaces. The cavity includes opposite end cavity portions located adjacent the housing opposite ends and a cavity connecting portion that is adjacent one of the housing sides and extends between the cavity end portions. The generally U-shaped switch blade member has its arms received in the cavity end portions and its base portion received in the cavity connecting portion.

The cavity includes a generally T-shaped portion that has a crossing portion with a leg portion extending therefrom in a direction longitudinally between the opposite ends of the polymeric housing. The resilient switch blade is received in the cavity crossing portion while the actuator is received in the cavity leg portion.

The front surface of the housing has a pair of notches extending between the cavity and the opposite end portions of the housing for receiving the terminal leads. The notches are centrally located between the opposite sides of the housing although other locations are possible.

A plurality of fastener projections are ultrasonically welded to the front surface of the housing and extend upwardly therefrom for reception in a plurality of fastener receiving holes in a flat cover to attach the cover to the plane front surface of the housing for closing the cavity and securing the terminals to the housing.

It is a principal object of the present invention to provide an improved temperature actuated switch having an actuator of shape memory alloy.

It is another object of the invention to provide such a switch that has a minimum number of parts and is relatively simple to manufacture and assemble.

It is also an object of the invention to provide such a switch that allows the use of a thicker and stronger switch blade material to minimize fatigue failure.

DESCRIPTION OF A PREFERRED EMBODIMENT

Figure 1:
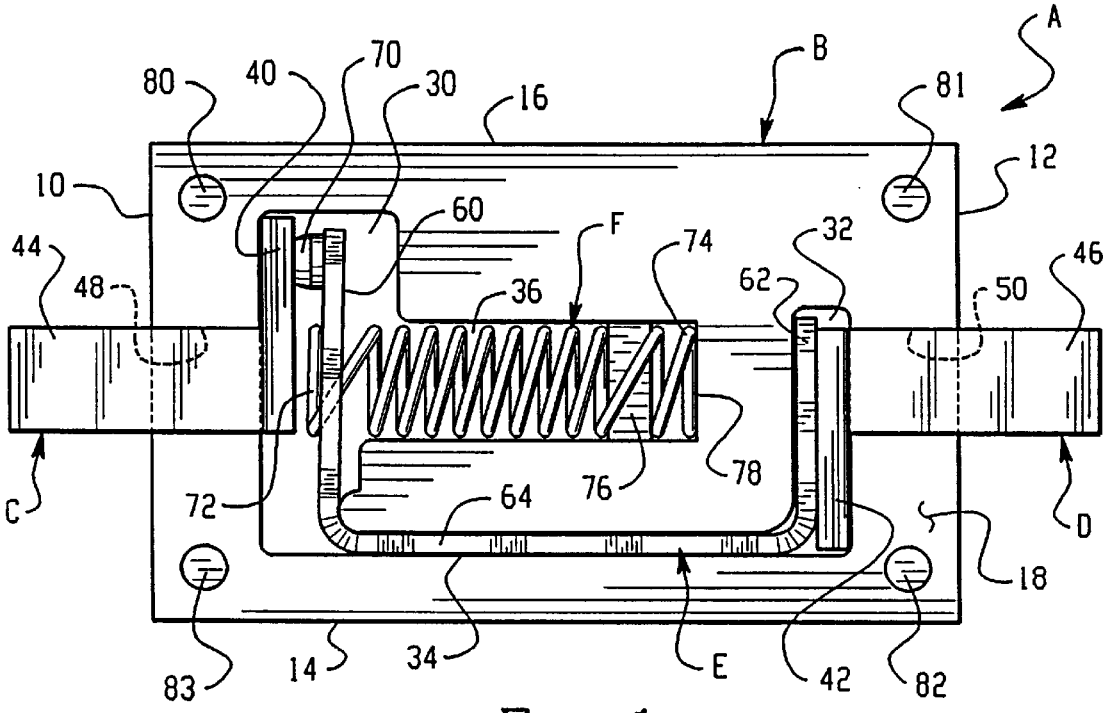
FIG. 1 is a top plan view of a relay or thermostat constructed in accordance with the present application and with a switch blade shown in a closed position.

Referring now to the drawing, wherein the showings are for purposes of illustrating a preferred embodiment of the invention only and not for purposes of limiting same, relay or thermostat A includes a polymeric housing B having opposite ends 10, 12, opposite sides 14, 16 and opposite front and rear surfaces 18, 20. Although housing B is illustrated in a preferred form as a rectangular solid with the opposite ends, sides and surfaces plane and parallel, it will be recognized that other shapes are also possible.

Housing B has a cavity extending inwardly thereof from plane front surface 18, and includes opposite cavity end portions 30, 32 located adjacent opposite ends 10, 12 and a cavity connecting portion 34 that extends between cavity end portions 30, 32 adjacent side 14.

The cavity in housing 16 further includes an actuator receiving leg portion 36 that extends from cavity end portion 30 toward cavity end portion 32 and terminates short of cavity end portion 32. Cavity end portion 30 and cavity leg portion 36 together form a generally T-shaped cavity portion within end portion 30 being a crossing portion of the T-shaped cavity and cavity portion 36 being the leg portion thereof.

A pair of terminals C, D have terminal contacts 40, 42 positioned within cavity end portions 30, 32 and terminal leads 44, 46 extending from terminal contacts 40, 42 outwardly of housing ends 10, 12. Front surface 18 of housing B has central notches 48, 50 extending from cavity end portions 30, 32 to housing opposite ends 10, 12. Terminal leads 44, 46 are received in notches 48, 50 and the depth of the notches is substantially the same as the thickness of the terminal leads 44, 46.

A switch blade member E has a generally U-shaped configuration that includes a pair of spaced-apart generally parallel arms 60, 62 connected by a base portion 64. Arms 60 and 62 are received in cavity end portions 30, 32, while base portion 64 is received in cavity connecting portion 34. Arm 62 of switch blade member E is under bending stress in engagement with terminal contact 42. Arm 60 on one-piece switch blade member E is longer than arm 62 and defines a resilient switch blade having a movable contact 70 thereon for cooperation with fixed terminal contact 40.

An elongated actuator F of shape memory alloy is received in cavity leg portion 36. In the arrangement shown and described, actuator F is in the shape of a coil spring having a plurality of coil turns. One end portion 72 is attached to resilient switch blade 60 by extending switch blade 60 between adjacent coils in end portion 72. Actuator F has an opposite distal end portion 74 that is anchored to housing B. In a preferred arrangement, an anchor projection 76 molded integrally in one-piece with housing B extends upwardly from the bottom of cavity leg portion 36 in spaced relationship to cavity leg portion distal end 78 and is received between adjacent coils of actuator F in distal end portion 74 thereof.

Figure 2:
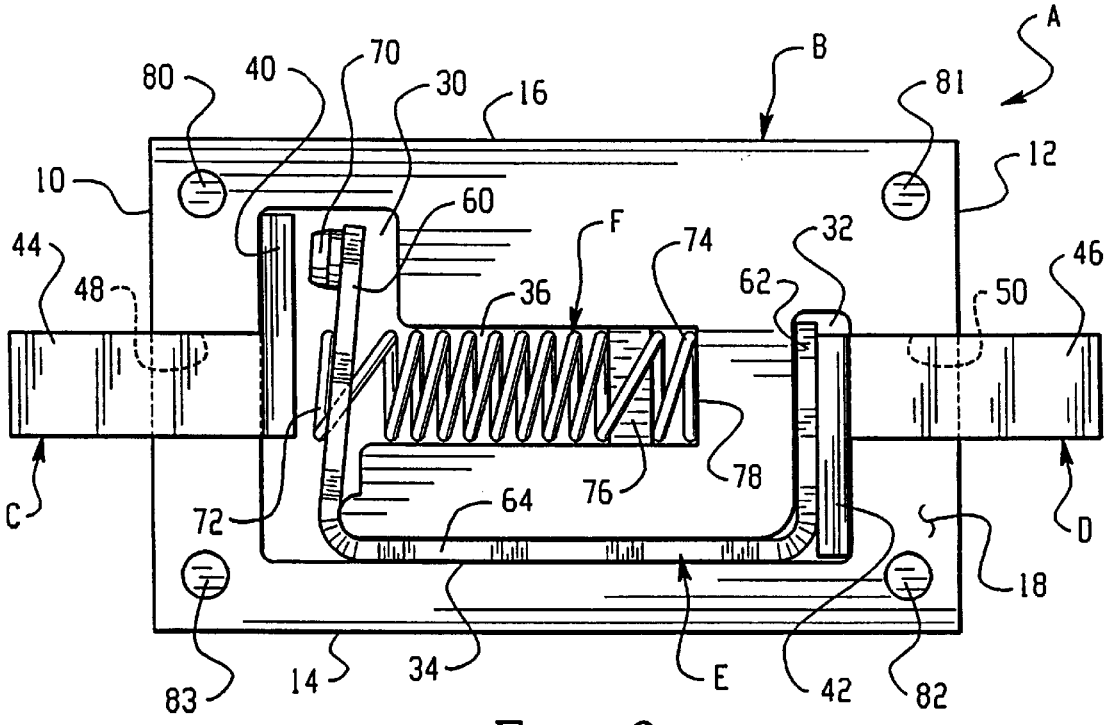
FIG. 2 is a view similar to FIG. 1 showing the switch blade in an open position.

Elongated actuator F of shape memory alloy has an extended deformed shape at normal temperatures wherein contacts 40, 70 are closed as shown in FIG. 1 and a contracted recovered shape at an elevated temperature wherein contacts 40, 70 are open as shown in FIG. 2. When actuator F changes from its deformed to its recovered shape, it pulls resilient switch blade 60 from the position of FIG. 1 to the position of FIG. 2 and moves movable contact 70 out of engagement with fixed terminal contact 40. Upon cooling, actuator F preferably reverts to its extended deformed shape to permit reverse movement of switch blade 60 back to the position of FIG. 1 for reclosing contacts 40, 70.

It will be recognized that the switch can be designed to be normally open rather than normally closed. For example, the normal position of the switch could be as shown in FIG. 2 with shape memory actuator F having a shortened length in its deformed shape at normal temperatures to hold switch blade 60 open and in bending stress. At the austenite transformation temperature of the shape memory alloy, actuator F would revert to its elongated recovered shape to allow movement of switch blade 60 to the left in FIG. 2 to close the contacts. In the alternative, fixed contact 70 could be on the opposite side of switch blade 60 in FIG. 1 and movable contact could be moved to the other surface of the switch blade. The configuration of FIG. 1 then would be normally open. Upon moving to the position of FIG. 2, the relocated fixed and movable contacts would be closed.

Although the actuator has the preferred shape of a coil spring, it will be recognized that other configurations may be possible to provide contraction and expansion as the actuator changes between its deformed and recovered shapes. For example, the actuator may be undulating somewhat in the manner of a sine wave or reversely turned somewhat like a bellows or accordion-type of configuration but with smooth turns rather than sharp bends.

Switch blade member E may be made of beryllium copper or other suitable materials. The high force provided by shape memory actuator F permits the use of thicker and stronger flat material for switch blade member E so that resilient switch blade 60 can undergo more opening and closing cycles without suffering fatigue failure. In addition, the thicker material permits switch blade 60 to self-bias movable contact 70 into engagement with fixed terminal contact 40 with relatively high force to minimize resistance.

In manufacturing shape memory actuator F, a wire is wound into the shape of a coil spring and heated to the austenitic transformation temperature of the shape memory alloy. After cooling to its martensitic state, actuator F is stretched to its desired length for use in the application shown in FIG. 1. When actuator F is again heated to its austenitic transformation temperature, it contracts or longitudinally shrinks back to the length that it had before it was stretched as shown in FIG. 2. The stretched length is commonly known as the deformed shape that the shape memory actuator has at normal temperatures. The contracted or shrunk configuration of the actuator is known as its recovered shape that it assumes at the austenitic transformation temperature. The actuator preferably is processed so that upon cooling back to its martensitic state it elongates to permit reclosing of the contacts.

Actuator F preferably is of a nickel-titanium shape memory alloy. However, it will be appreciated that it may be possible to use other shape memory alloys such as copper-based ternaries including copper-zinc-aluminum, and copper-nickel-aluminum. The transition temperature range at which the alloy changes from its deformed shape to its recovered shape can be varied by selecting different shape memory alloy compositions and by varying the heat treating process.

Figure 3:
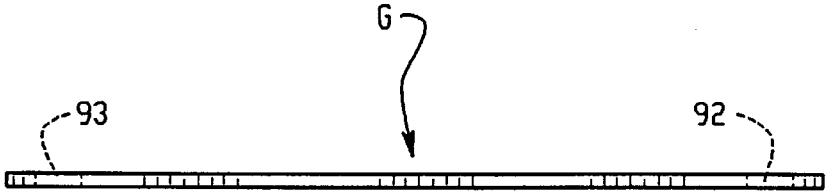
FIG. 3 is a side elevational view of a housing cover used with the relay of FIGS. 1 and 2.
Figure 4:
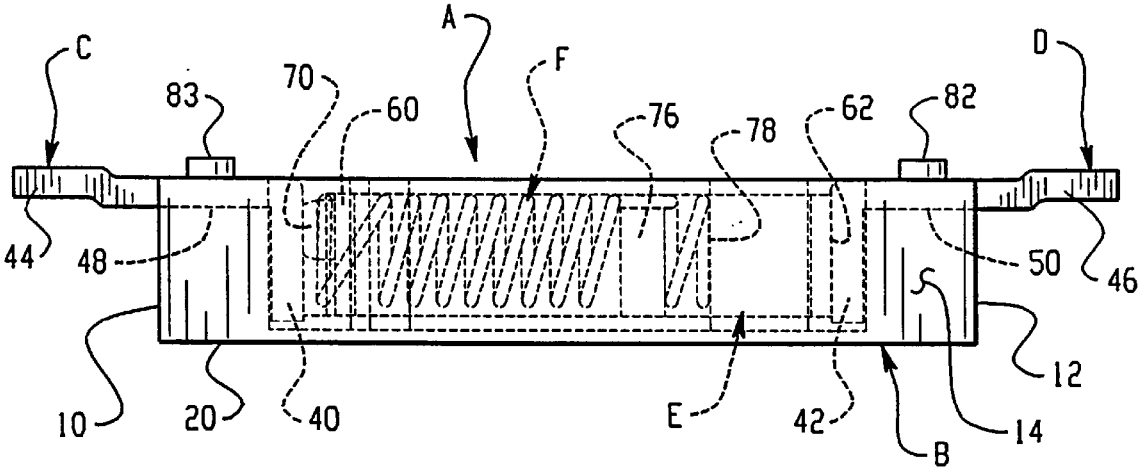
FIG. 4 is a side elevational view of the relay or thermostat of FIGS. 1 and 2.

Housing B has a plurality of fastener projections 80–83 formed integrally in one-piece therewith and projecting upwardly from plane front surface 18. A flat rectangular polymeric housing cover G in FIG. 3 has a plurality of fastener receiving holes therethrough, only two of which are shown at 92 and 93 in FIG. 3. The holes are equal in number to fastener projections 80–83 and are positioned for reception of fastener projections 80–83 through the cover holes. Fastener projections 80–83 then are deformed for attaching cover G to outer surface 18 of housing B to close the entire housing cavity and to secure terminals C, D to the housing assembly.

Strictly by way of example and not by way of limitation, housing member B may have a length between opposite ends 10, 12 of about 0.562 inch, a width between opposite sides 14, 16 of about 0.340 inch and a thickness between front and rear surfaces 18, 20 of about 0.111 inch. Projections 80–83 extend upwardly from front surface 18 about 0.010 inch. The length of spring F in its relaxed uninstalled condition is about 0.275 inch as measured between its opposite ends. Spring F is made from circular wire having a diameter of about 0.010 inch and is formed into a cylindrical coil having an internal diameter of about 0.070 inch. Switch blade member E has a thickness of about 0.010 inch and a width of about 0.070 inch. The length of switch member E between the outwardly facing surfaces of switch blade 60 and arm 62 is about 0.395 inch.

Although the invention has been shown and described with reference to a preferred embodiment, it is obvious that equivalent alterations and modifications will occur to others skilled in the art upon the reading and understanding of this specification. The present invention includes all such equivalent alterations and modifications, and is limited only by the scope of the claims.

We claim:

1. A temperature actuated switch comprising a polymeric housing having a cavity therein, a pair of terminals having terminal contacts in said cavity and terminal leads extending externally of said housing from said terminal contacts, a resilient switch blade having a movable blade contact normally engaging one of said terminal contacts, said switch blade being connected in electrically conductive relationship with the other of said terminal contacts, an actuator of shape memory alloy positioned in said cavity said actuator being in the shape of a coil spring and having one actuator end portion attached to said switch blade and an opposite actuator end portion attached to said housing, said actuator having an extended deformed shape at normal temperatures wherein said blade contact engages said one of said terminal contacts, and said actuator having a contracted recovered shape at an elevated temperature wherein said actuator bends said switch blade in a direction away from said one of said terminal contacts to separate said blade contact from said one of said terminal contacts.

2. The switch of claim 1 wherein said coil spring has a plurality of coil turns and said switch blade is received between adjacent ones of said coil turns in said one end portion of said actuator.

3. The switch of claim 1 wherein said cavity has an anchor projection therein and said anchor projection is received between adjacent ones of said coil turns in said opposite end portion of said actuator.

4. The switch of claim 1 wherein said housing has opposite housing ends and said terminal leads extend externally of said housing at said opposite housing ends.

5. The switch of claim 1 wherein said cavity includes a generally T-shaped portion having a crossing portion and a leg portion extending from said crossing portion, said switch blade and said one of said terminal contacts being in said crossing portion of said cavity and said actuator being in said leg portion thereof.

6. The switch of claim 5 wherein said leg portion of said cavity has a distal end portion remote from said crossing portion, an anchor projection in said distal end portion of said cavity, and said opposite end portion of said actuator being attached to said anchor projection.

7. The switch of claim 6 wherein said actuator is in the shape of a coil spring having a plurality of coil turns, said switch blade extending between adjacent ones of said coil turns in said one end portion of said actuator, and said anchor projection extending between adjacent ones of said coil turns in said opposite end portion of said actuator.

8. The switch of claim 1 including a one-piece switch blade member having a generally U-shaped configuration with a pair of spaced-apart arms that are connected by a base portion, said switch blade being defined by one of said arms, and the other of said arms being in engagement with said other of said terminal contacts.

9. The switch of claim 8 wherein said one of said arms has a length that is substantially greater than the length of said other of said arms.

10. The switch of claim 1 wherein said housing has opposite ends and opposite sides, said terminals being located adjacent said opposite ends with said terminal leads extending externally of said housing at said opposite ends thereof, said cavity having a generally U-shaped cavity portion with cavity end portions located adjacent said housing end portions and with said cavity end portions being connected by a cavity connecting portion that extends between said cavity end portions adjacent one of said housing sides, said cavity having a cavity leg portion spaced from said cavity connecting portion and extending from one of said cavity end portions toward the other of said cavity end portions, said cavity leg portion having a distal end portion located adjacent to but spaced from the other of said cavity end portions, said switch blade being part of a generally U-shaped switch blade member that has switch blade member arms received in said cavity end portions and a switch blade member base portion received in said cavity connecting portion, said switch blade being defined by one of said switch blade member arms, the other of said switch blade member arms being in engagement with the other of said terminal contacts, and said actuator being positioned in said cavity leg portion.

11. The switch of claim 10 wherein said actuator is in the shape of a coil spring having a plurality of coil turns, said switch blade being received between adjacent ones of said coil turns in said one end portion of said actuator, and said distal end portion of said leg portion of said cavity having an anchor projection received between adjacent ones of said coil turns in said other of said actuator end portions.

12. The switch of claim 1 including a cover closing said cavity, said housing having a plurality of integral fastener projections extending therefrom, and said cover having fastener receiving holes through which said fastener projections extend to attach said cover to said housing.

13. A switch assembly comprising a polymeric housing having opposite ends, opposite side and opposite front and rear surfaces, a cavity in said front surface, notches in said front surface extending between said cavity and said opposite ends, a pair of terminals having terminal leads received in said notches and terminal contacts positioned in said cavity, a switch blade positioned in said cavity and having a blade contact normally engaging one of said terminal contacts, said switch blade being connected in electrically conductive relationship with the other of said terminal contacts, an elongated actuator of shape memory alloy having an end portion attached to said switch blade, said actuator having an extended deformed shape at normal temperatures wherein said blade contact engages said one of said terminal contacts, and said actuator having a contracted recovered shape at an elevated temperature wherein said switch blade is moved to an open position with said blade contact separated from said one of said terminal contacts.

14. The switch assembly of claim 13 wherein said notches have a notch depth and said terminal leads have a terminal lead thickness, and said notch depth being substantially the same as said terminal lead thickness.

15. The switch assembly of claim 14 including a cover attached to said front surface to close said cavity and secure said terminals to said housing.

16. The switch assembly of claim 15 including fastener projections extending upwardly from said front surface of said housing, and said cover having fastener receiving holes therein through which said fastener projections extend to attach said cover to said housing.

17. The switch assembly of claim 13 wherein said actuator extends in a direction between said opposite ends and has a distal end portion spaced from said one end portion thereof that is attached to said switch blade, an anchor projection in said cavity and being integral in one-piece with said housing, and said distal end portion being attached to said anchor projection.

18. The switch assembly of claim 13 wherein said actuator is in the shape of a coil spring having a plurality of coils, and said actuator extending through adjacent ones of said plurality of coils in said one end portion of said actuator to attach said actuator to said switch blade.

19. The switch assembly of claim 18 wherein said spring has a distal end portion opposite from said one end portion thereof, and an anchor projection in said cavity received between adjacent ones of said coils in said distal end portion.

20. A switch assembly including an actuator of shape memory alloy being in the shape of a coil spring, a resilient switch blade, said switch assembly having a fixed contact and said switch blade having a movable contact, said switch blade being movable between contact closed and contact open positions, said actuator having an end portion attached to said switch blade, said actuator having an extended deformed shape at normal temperatures and a contracted recovered shape at an elevated temperature, and said contacts being in said closed position when said actuator is in one of said shapes and being in said open position when said actuator is in the other of said shapes.

21. The switch of claim 19 wherein said coil spring has a plurality of coil turns and said switch blade is received between adjacent ones of said coil turns in said one end portion of said actuator.

22. The switch of claim 21 wherein said cavity has an anchor projection therein and said anchor projection is received between adjacent ones of said coil turns in said opposite end portion of said actuator.

23. The switch of claim 21 wherein said cavity includes a generally T-shaped portion having a crossing portion and a leg portion extending from said crossing portion, said switch blade and said one of said terminal contacts being in said crossing portion of said cavity and said actuator being in said leg portion thereof.

24. The switch of claim 23 wherein said leg portion of said cavity has a distal end portion remote from said crossing portion, an anchor projection in said distal end portion of said cavity, and said opposite end portion of said actuator being attached to said anchor projection.

25. The switch of claim 24 wherein said actuator is in the shape of a coil spring having a plurality of coil turns, said switch blade extending between adjacent ones of said coil turns in said one end portion of said actuator, and said anchor projection extending between adjacent ones of said coil turns in said opposite end portion of said actuator.

26. The switch of claim 20 including a one-piece switch blade member having a generally U-shaped configuration with a pair of spaced-apart arms that are connected by a base portion, said switch blade being defined by one of said arms, and the other of said arms being in engagement with said other of said terminal contacts.

* * * * *

UNITED STATES PATENT AND TRADEMARK OFFICE

CERTIFICATE OF CORRECTION

PATENT NO. : 6,239,686 B1
DATED : May 29, 2001
INVENTOR(S) : Philip B. Eder et al.

It is certified that error appears in the above-identified patent and that said Letters Patent is hereby corrected as shown below:

Column 5,
Line 44, "1" should be -- 2 --.

Column 6,
Line 44, "side" should be -- sides --.

Column 8,
Line 1, "19" should be -- 20 --.

Signed and Sealed this

Twenty-eighth Day of May, 2002

*Attest:*

*Attesting Officer*

JAMES E. ROGAN
*Director of the United States Patent and Trademark Office*